US010458613B2

(12) United States Patent
Vincens

(10) Patent No.: US 10,458,613 B2
(45) Date of Patent: Oct. 29, 2019

(54) VEHICLE LIGHT SOURCE

(71) Applicant: MLS Automotive, Inc, Farmington Hills, MI (US)

(72) Inventor: Adam J. Vincens, Plymouth, MI (US)

(73) Assignee: MLS Automotive, Inc, Farmington Hills, MI (US)

( * ) Notice: Subject to any disclaimer, the term of this patent is extended or adjusted under 35 U.S.C. 154(b) by 9 days.

(21) Appl. No.: 16/195,405

(22) Filed: Nov. 19, 2018

(65) Prior Publication Data

US 2019/0154220 A1 May 23, 2019

Related U.S. Application Data

(60) Provisional application No. 62/588,829, filed on Nov. 20, 2017.

(51) Int. Cl.
*F21V 21/00* (2006.01)
*F21S 41/19* (2018.01)
*F21S 41/151* (2018.01)

(52) U.S. Cl.
CPC ..... *F21S 41/192* (2018.01); *F21S 41/151* (2018.01)

(58) Field of Classification Search
CPC ..... F21S 41/192; F21S 41/151
USPC ..... 362/545, 249.02
See application file for complete search history.

(56) References Cited

U.S. PATENT DOCUMENTS 7,993,043 B2 * 8/2011 Sazuka ..... B60Q 1/14 362/509
8,292,479 B2 * 10/2012 Sazuka ..... F21V 29/74 362/511
8,752,978 B2 * 6/2014 Bloom ..... H05B 33/089 362/223
8,833,989 B2 * 9/2014 Barton ..... B60Q 1/268 362/249.02
2009/0161359 A1 * 6/2009 Siemiet ..... F21S 4/28 362/235
2009/0323368 A1 12/2009 Campbell et al.
2011/0280031 A1 11/2011 Luger et al.
2012/0008317 A1 * 1/2012 Kobayashi ..... G02B 27/2285 362/231
2013/0033883 A1 2/2013 Ward et al.
2013/0077312 A1 * 3/2013 Van Herpen ..... D05C 17/02 362/249.02

(Continued)

FOREIGN PATENT DOCUMENTS

WO WO-2017/020438 A1 2/2017

OTHER PUBLICATIONS https://www.superbrightleds.com/moreinfo/daytime-running-lights/h11-led-bulb-led-foglightdaytime-running-light-bulb-28-smd-ledtower/1278/.

(Continued)

*Primary Examiner* — Laura K Tso
(74) *Attorney, Agent, or Firm* — Foley & Lardner LLP

(57) ABSTRACT

A light source for a vehicle includes a first substrate, a second substrate, a first light emitting element, and a second light emitting element. The second substrate is spaced apart from the first substrate. The first light emitting element is coupled to a surface of the first substrate that faces the second substrate. The first light emitting element is configured to emit light through the second substrate. The second light emitting element is coupled to a surface of the second substrate that faces the first substrate. The second light emitting element is configured to emit light through the first substrate.

20 Claims, 8 Drawing Sheets

(56) References Cited

U.S. PATENT DOCUMENTS

| | | | | |
|---|---|---|---|---|
| 2013/0100684 | A1 | 4/2013 | Lin et al. | |
| 2016/0154170 | A1 | 6/2016 | Thompson et al. | |
| 2018/0023795 | A1* | 1/2018 | Elwell | F21S 41/192 362/249.02 |

OTHER PUBLICATIONS https://www.usa.philips.com/c-p/78719719/x-tremevision-led-fog-lamp.

International Search Report and Written Opinion for International Appl. No. PCT/US2018/061837, dated Feb. 11, 2019.

* cited by examiner

VEHICLE LIGHT SOURCE

CROSS-REFERENCE TO RELATED APPLICATIONS

This application claims the benefit of and priority to U.S. Provisional Application No. 62/588,829, filed Nov. 20, 2017, the entire disclosure of which is hereby incorporated by reference herein.

BACKGROUND

The present application relates generally to vehicle lighting. More specifically, the present application relates to a non-incandescent light source for a vehicle.

SUMMARY

One embodiment of the present application relates to a light source for a vehicle including a first substrate, a second substrate, a first light emitting element, and a second light emitting element. The second substrate is spaced apart from the first substrate. The first light emitting element is coupled to a surface of the first substrate that faces the second substrate. The first light emitting element is configured to emit light through the second substrate. The second light emitting element is coupled to a surface of the second substrate that faces the first substrate. The second light emitting element is configured to emit light through the first substrate.

Another embodiment relates to a light source for a vehicle including a first substrate, a second substrate, a first LED, and a second LED. The second substrate is spaced apart from the first substrate. The first LED is coupled to a surface of the first substrate that faces the second substrate. The first LED is configured to emit light through the second substrate. The second LED is coupled to a surface of the second substrate that faces the first substrate. The second LED is configured to emit light through the first substrate.

Another embodiment relates to a light source for a vehicle including a first substrate, a second substrate, a first light emitting element, and a second light emitting element. The first substrate includes a substantially transparent portion. The second substrate is spaced apart from the first substrate and includes a substantially transparent portion. The first light emitting element is coupled to a surface of the first substrate that faces the second substrate. The first light emitting element is configured to emit light through the substantially transparent portion of the second substrate. The second light emitting element is coupled to a surface of the second substrate that faces the first substrate. The second light emitting element is configured to emit light through the substantially transparent portion of the first substrate.

DETAILED DESCRIPTION

Referring generally to the FIGURES, disclosed herein are various exemplary embodiments of a non-incandescent light source for a vehicle that is configured as a direct replacement for a tungsten-halogen light source (e.g., H11, HB2, HB3, H7, H4, etc.) or other incandescent light source on a vehicle (e.g., 3156/7, T-20 and other signal and marking lamps based on plastic and glass wedge-type bases that are listed in SAE J573 for miniature lamps). The light source of the present application can, advantageously, produce a light emission pattern (e.g., visible light radiation pattern, etc.) that is substantially the same as, or similar to, the emission pattern of a traditional tungsten-halogen bulb or incandescent bulb (e.g., a $4\pi$ radiation pattern, etc.), while providing for improved brightness, useful life, reliability, and customization, as compared to traditional tungsten-halogen bulbs and aftermarket LED light sources. The disclosed light source can be used for any automotive lighting function, such as high beam (upper beam), low beam (lower beam), front fog lamp, signal functions (e.g., front turn signal, rear turn signal, back-up (reversing lamp), rear fog, stop, tail, high mount stop lamp, etc.), or other automotive lighting applications.

Generally speaking, traditional automotive exterior lighting has included halogen sealed beams and other incandescent light sources. More recently, the automotive industry has started transitioning to LED and other non-incandescent light sources for roadway illumination and light signaling, such as laser diode, laser activated remote phosphor, organic LED (OLED), and other non-incandescent light sources.

Currently, however, there is no standard non-incandescent light source on the market that can replace a traditional tungsten-halogen or incandescent light source on vehicles that originally came equipped with these light sources. There are numerous aftermarket products that claim to be retrofit LED light sources. Most of these aftermarket products, however, do not accurately replicate the beam pattern produced by the tungsten filament they claim to replace, which is often due to differences in the light emitting area of the light source itself. Thus, when these aftermarket LED light sources are used in, for example, headlight assemblies including reflectors that are specifically designed for tungsten-halogen light sources, the light produced by these LED light sources is scattered and can cause nuisance glare to oncoming drivers.

Figure 1:
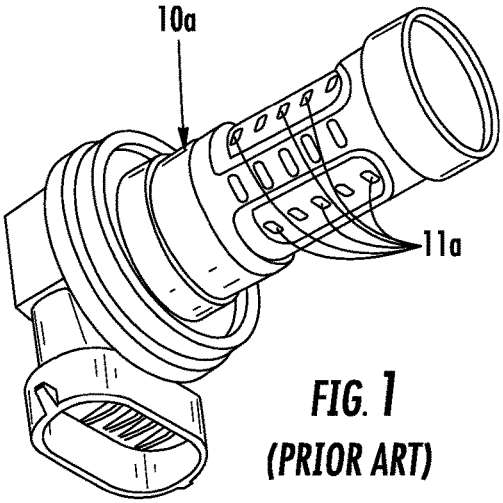
FIG. 1 (PRIOR ART)
FIGS. 1-5 are perspective views of various prior art vehicle light sources.
Figure 2:
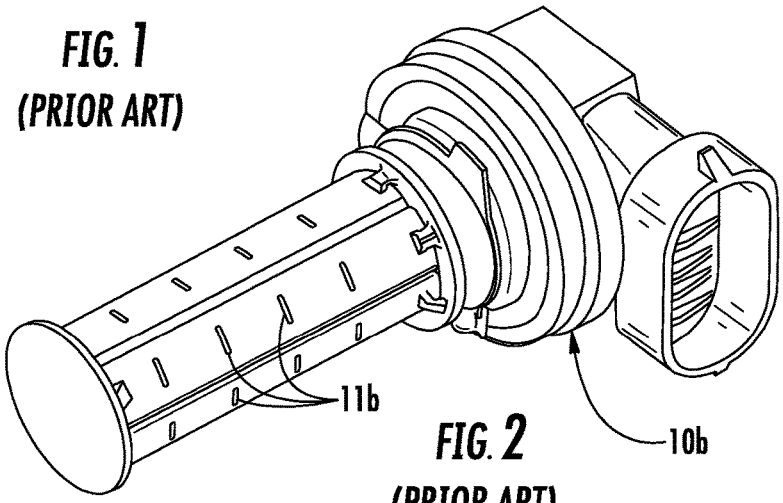
FIG. 2 (PRIOR ART)
Figure 3:
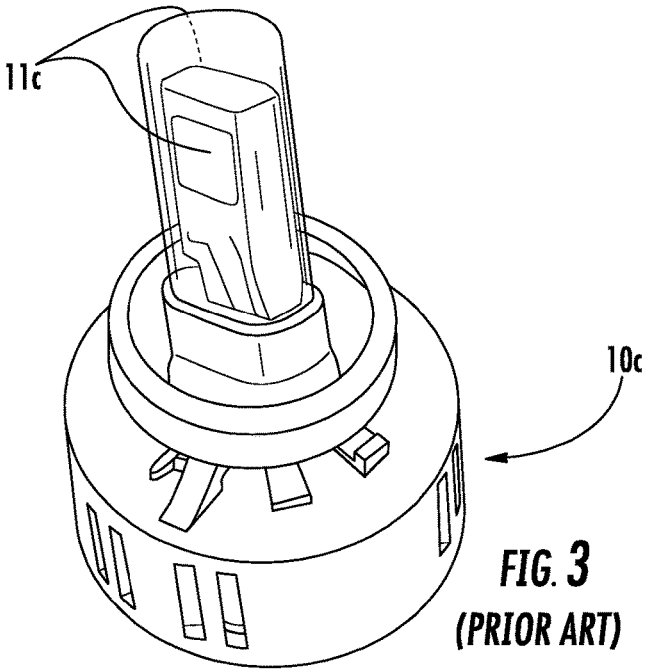
FIG. 3 (PRIOR ART)

For example, to increase the amount of light output or to create the appearance of increased brightness, many aftermarket LED light sources include additional light emitting elements (e.g., LEDs, etc.) located in the proximity of the designed "light center" or focal point of the light source. Referring to FIGS. 1-3, for example, three different prior art aftermarket LED light sources 10*a*, 10*b*, 10*c* are shown. As shown in FIGS. 1-3, each of the light sources 10*a*, 10*b*, 10*c* includes a plurality of LEDs 11*a*, 11*b*, 11*c*, respectively, that are coupled along a periphery of each light source. Due to the number of LEDs 11*a*, 11*b*, 11*c* required to achieve a desired brightness, and due to the small size of the light source package, at least some of the LEDs 11*a*, 11*b*, 11*c* are moved away from the designed focal point of the light source, which can result in reduced photometric efficacy and increased nuisance-glare to other nighttime road users (e.g., due to light scattering, etc.).

Figure 4:
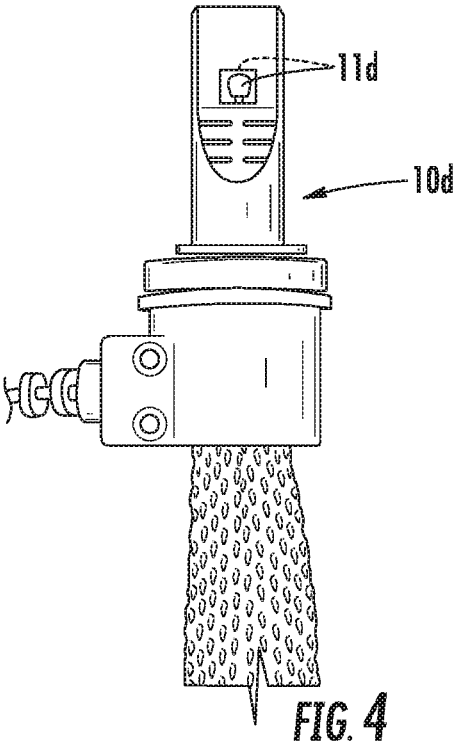
FIG. 4 (PRIOR ART)

In addition, some aftermarket LED light sources have light emission windows that are significantly different from the light emission windows of traditional tungsten-halogen bulbs, such that the resulting beam patterns of the LED light sources vary from the beam patterns of tungsten-halogen bulbs, which can result in increased nuisance glare and poor illumination for a driver. For example, FIG. 4 illustrates a prior art aftermarket LED light source 10*d*. The LED light source 10*d* includes a pair of LEDs 11*d* arranged back-to-back on a single substrate/circuit board. The light emission window of the LED light source 10*d* has a square shape and has a size of approximately 2 mm by approximately 2 mm. In contrast, the light emission window of a typical tungsten-halogen filament is rectangular in shape and has a size of approximately 5 mm by approximately 1 mm. This difference in the light emission windows causes the resulting beam patterns to vary, which can cause increased nuisance glare and reduced photometric efficacy for the LED light source, as compared to the tungsten-halogen light source.

Figure 5:
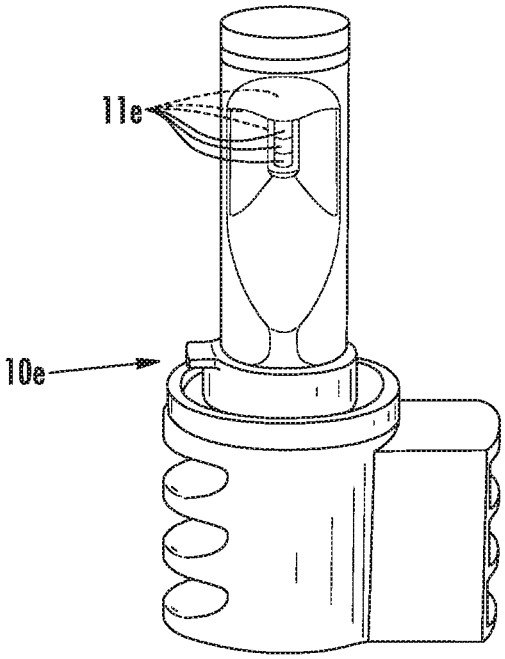
FIG. 5 (PRIOR ART)

Similarly, FIG. 5 illustrates a prior art aftermarket LED light source 10*e* including three discrete LEDs 11*e* arranged on each side of a single substrate. The discrete position of each LED 11*e* causes an uneven break in the light emission window of the light source 10*e*, similar to the LED light sources of FIGS. 1-3. In contrast, traditional tungsten-halogen light sources have continuous, uninterrupted light emission windows. Thus, the resulting beam pattern of the LED light source 10*e* is significantly different from the beam pattern of a traditional tungsten-halogen bulb, resulting in increased nuisance glare and reduced photometric efficacy.

Additionally, because the LEDs 11*d*, 11*e* are each located on opposite sides of a single substrate/circuit board, the optical emission surface of the light sources 10*d*, 10*e* is separated by a distance that is much larger than the width of the tungsten-halogen filament, which functions as the optical emission surface of the traditional tungsten-halogen coil and is limited to the shape or diameter of the coil itself (e.g., approximately 1 mm in diameter, etc.). This separation in the optical emission surface can create gaps in the emission pattern resulting in "dim" areas in the beam pattern of the LED light source, which is undesirable. Furthermore, the waste heat produced by each LED 11*d*, 11*e* is concentrated at the base of the LED die on each side of the same substrate/circuit board, which can cause an increase in the thermal load of each LED and can reduce the luminous efficacy of each LED.

Disclosed herein is a vehicle light source that can substantially replicate the beam pattern of a traditional tungsten halogen bulb, while providing for improved brightness, useful life, reliability, and customization, as compared to traditional tungsten-halogen bulbs and aftermarket LED light sources. According to an exemplary embodiment, the light source includes two substantially parallel substrates and at least one LED coupled to each of the substrates, indirectly across from each other. The substrates each include a substantially transparent portion to allow for light emitted from the LEDs to pass through an opposite substrate along the primary emission axis of each LED. In this manner, the disclosed light source can provide an improved beam pattern by avoiding displacement of the light center of the LEDs, as compared to typical aftermarket LED light sources. Furthermore, by placing the LEDs on opposite substrates, the thermal resistance of each LED can be reduced and the luminous efficacy improved, because the waste heat produced by the LEDs at the base of each LED die is distributed to separate substrates that are spaced apart from each other, instead of a single substrate.

Additionally, the disclosed LED light source includes a rotary assembly that allows for optical adjustment of the resulting beam pattern from the LEDs, to thereby achieve an optimum beam pattern for a particular lighting application, unlike conventional aftermarket LED light sources, which typically have fixed beam patterns.

Referring to FIGS. 6-11, a light source 20 for a vehicle (e.g., vehicle light source, LED light source, light module, etc.) is shown according to an exemplary embodiment of the present application. The light source 20 includes a pair of substrates 25 (e.g., first and second substrates, panels, members, boards, etc.) oriented substantially parallel to each other. According to an exemplary embodiment, the substrates 25 are spaced apart from each other by approximately 1.0 mm (e.g., ±50%) to accommodate an LED height of approximately 0.75 mm and a solder thickness of approximately 0.050 mm on the electrical trace, leaving approximately 0.20 mm between the light emitting element 32 and the substrate 25. This spacing, advantageously, reduces the optical emission surface of the light source, so as to mimic the emission surface of a typical tungsten-halogen light source. A first light emitting element 32 (e.g., first LED, etc.) is coupled to a facing surface of one of the substrates 25 (i.e., a surface of the substrate that faces the opposite substrate). A second light emitting element 33 (e.g., second LED, etc.) is coupled to a facing surface of the other substrate 25. According to other exemplary embodiments, the light source 20 includes more than one light emitting element coupled to each of the substrates 25. According to an exemplary embodiment, the first and second light emitting elements 32, 33 are LEDs. The LEDs may have a one, two, three, four, or other combination of a 'multi-die' LED package, a chip scale package, a chip on board or a die on ceramic arrangement. According to other exemplary embodiments, the light emitting elements 32, 33 are a phosphorescent plate with a remote light source, such as a laser diode.

As shown in FIGS. 6-11, the first light emitting element 32 is positioned offset from the second light emitting element 33 in a longitudinal direction, but is otherwise located across from the second light emitting element 33 (i.e., indirectly across). In other words, the light emitting elements 32, 33 are disposed on the facing surfaces of the substrates 25, with each light emitting element facing an opposite substrate. In this manner, heat generated by the light emitting elements 32, 33 can be distributed to separate substrates that are spaced apart from each other, instead of to a single substrate, thereby improving the thermal resistance and luminous efficacy of each light emitting element.

According to an exemplary embodiment, the substrates 25 are each made from a ceramic material, such as aluminum oxide. According to other exemplary embodiments, the ceramic material includes zirconia ($ZrO_2$), magnesia (MgO), or other substantially transparent ceramic materials (e.g., sapphire, garnet, YAG ceramic, or carbon (diamond)). For example, according to an exemplary embodiment, the substrates are made from $Al_2O_3$ (aluminum oxide, alumina or corundum) that is sintered in such a way, so as to control the grain size and reduce porosity to produce a substantially transparent substrate. The process to produce substantially transparent ceramic materials can include various sintering techniques, such as a spark plasma sintering (SPS), vacuum sintering, high pressure (HP), hot isostatic pressure (HIP), and microwave sintering on alumina, zirconia, and other more complex ceramics. The Applicant discovered that these materials can, advantageously, allow for improved thermal conductivity of the substrate and allow for a reduction in substrate thickness for vehicle lighting applications. According to an exemplary embodiment, the substrates 25 each have a thickness of approximately 0.5 mm (e.g., ±0.25 mm). Furthermore, the substrates 25 each have a generally planar shape, and include a substantially transparent portion (e.g., between approximately 60% and approximately 98% straight line transparency (±2.0%)). In this way, the substrates 25 define light emission windows that mimic the light emission window of a tungsten-halogen light source and can allow a substantial amount of light emitted from the light emitting elements 32, 33 to pass therethrough, the details of which are discussed in the paragraphs that follow.

Figure 8:
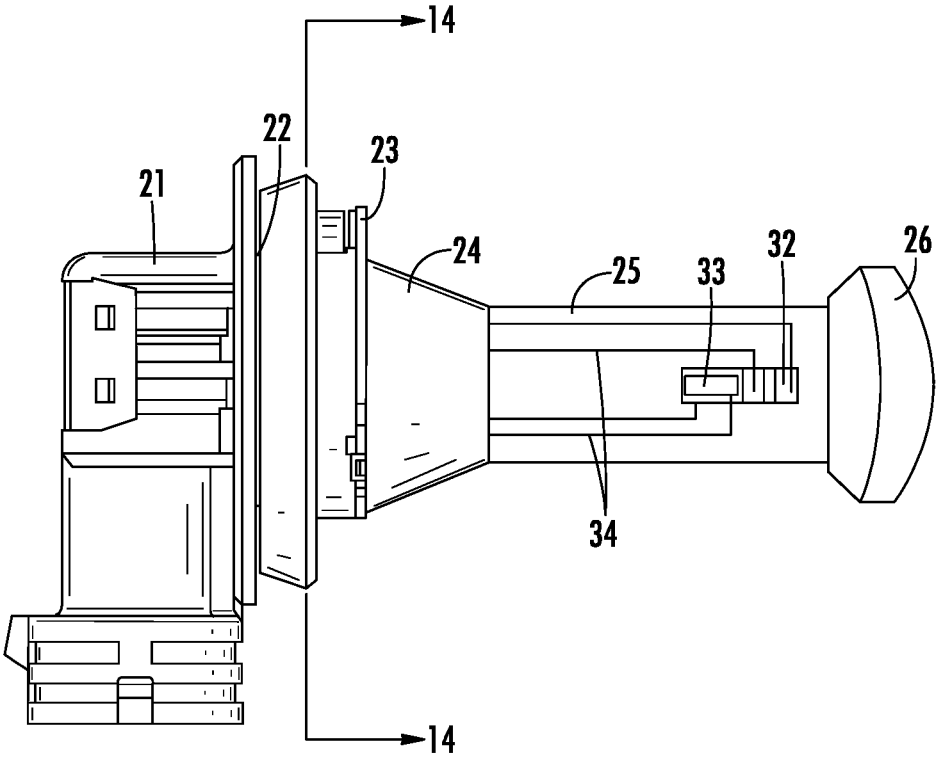
FIG. 8 is a side view of the vehicle light source of FIG. 6.

As shown in FIG. 8, the substrates 25 each include electrical traces 34 that form a circuit between the light emitting elements 32, 33 and respective electrical connections on the light source. According to various exemplary embodiments, the electrical traces 34 can form a series connection with the light emitting elements 32, 33, or can define two separate circuits (e.g., for high beam and low beam functions, stop and taillight functions, etc.). The electrical traces 34 can be formed from a silver ink or other metallic ink that is printed, laminated, or otherwise applied to each substrate 25. According to an exemplary embodiment, one or more of the substrates 25 includes a surface treatment on an outer and/or inner surface thereof, such as a texture, a coating, or the like, such that the substrate can distribute or diffuse at least some of the light emitted by the light emitting element 32, 33.

Figure 6:
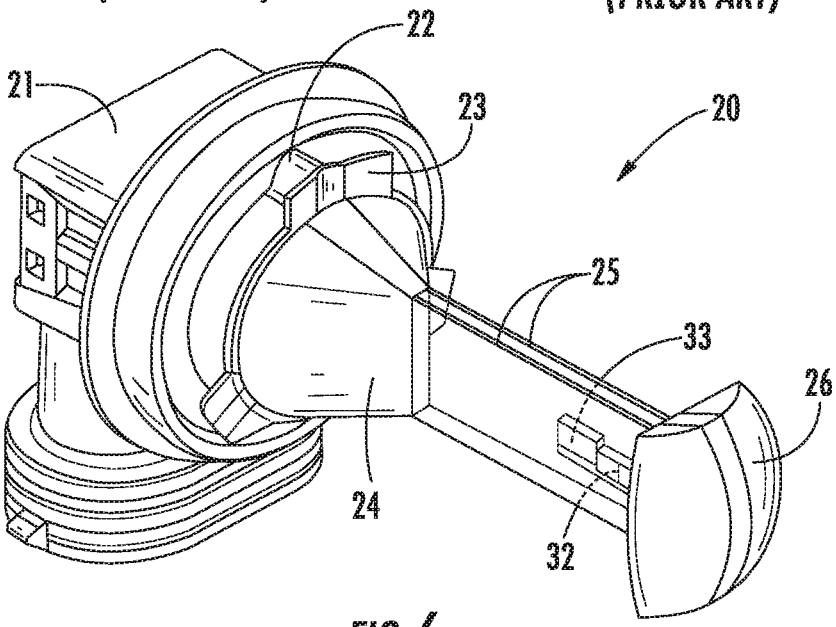
FIG. 6 is a perspective view of a vehicle light source according to an exemplary embodiment of the present application.
Figure 7:
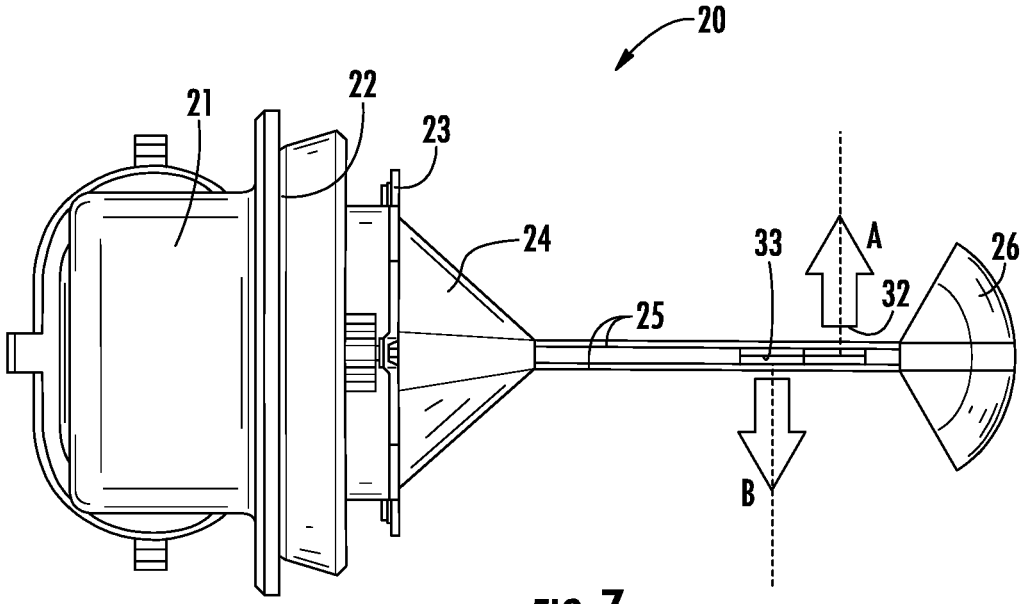
FIG. 7 is a top view of the vehicle light source of FIG. 6.

According to the exemplary embodiment shown in FIGS. 6-8, the substrates 25 are coupled to, or integrally formed with, a substrate base 24 at a proximal end of the substrates 25. The substrates 25 each extend outwardly away from the substrate base 24 to a distal end of the substrates in a cantilevered manner. A cap 26 is coupled to, or integrally formed with, the substrates 25 at the distal end. The cap 26 can be substantially opaque, which can, advantageously, obscure a direct view of the light emitting elements 32, 33 to help reduce or eliminate nuisance-glare that may be produced by the light source 20. In addition, according to an exemplary embodiment, the cap 26 can include fins, slots, or other heat dissipating features, so as to function as a heat sink for the substrates 25 (see FIG. 17).

Figure 9:
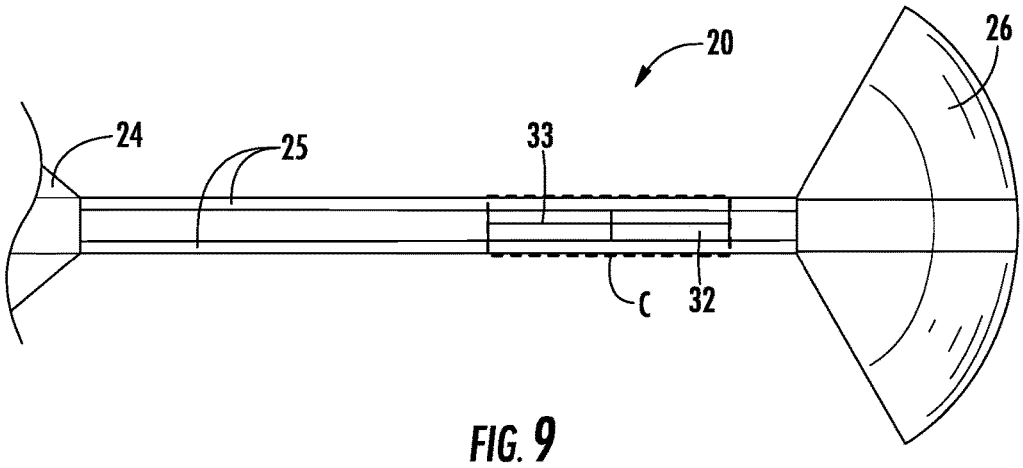
FIG. 9 is a partial top view of the vehicle light source of FIG. 6.
Figure 10:
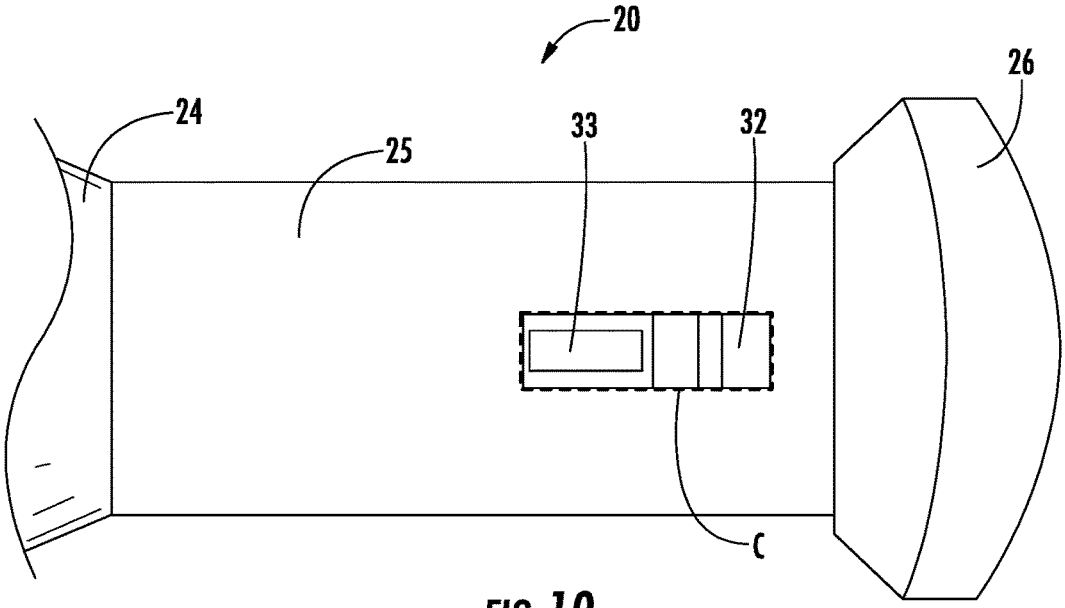
FIG. 10 is a partial side view of the vehicle light source of FIG. 6.
Figure 11:
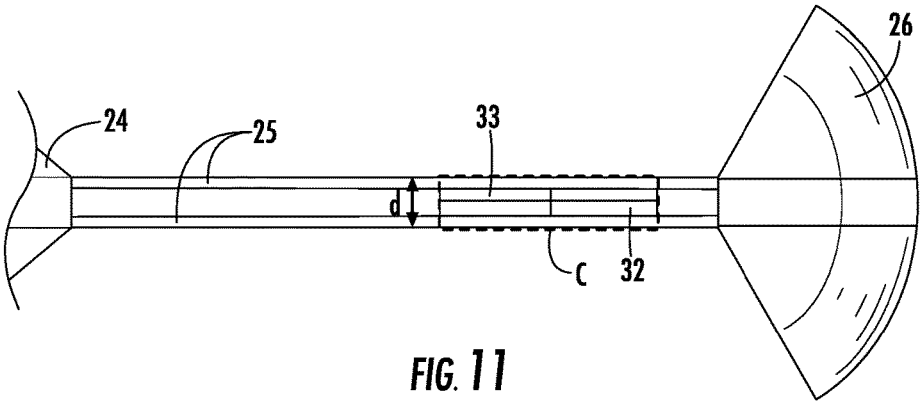
FIG. 11 is another partial top view of the vehicle light source of FIG. 6.
Figure 12:
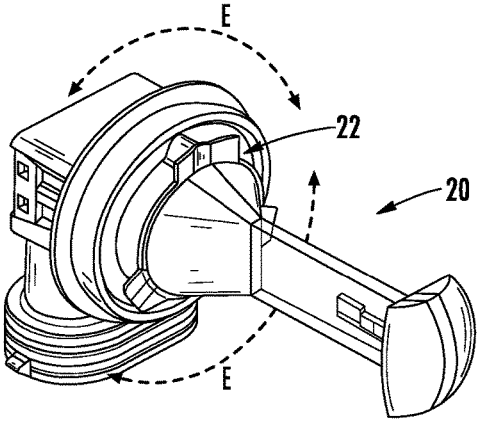
FIG. 12 is another perspective view of the vehicle light source of FIG. 6.
Figure 13:
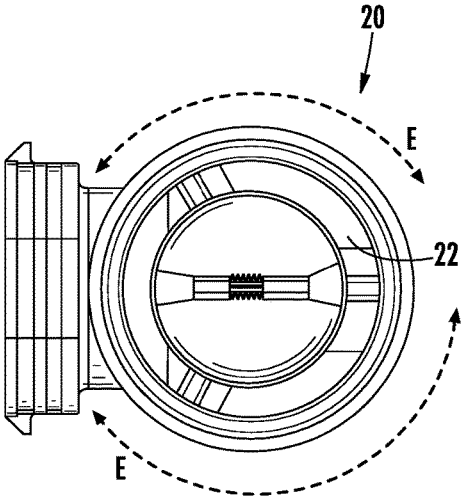
FIG. 13 is a front view of the vehicle light source of FIG. 6.

Referring to FIGS. 7-9, the light emitting element 32 has a primary light emission axis that is indicated generally by arrow "A" in FIG. 7. Similarly, light emitting element 33 has a primary light emission axis that is indicated generally by arrow "B" in FIG. 7. The primary light emission axes A, B are offset from each other in a longitudinal direction and project in opposite, substantially parallel directions through the substrates 25. As shown in FIGS. 7-8, the substantially transparent portions of the substrates 25 cooperatively define a light emission area that is indicated generally by a dashed box "C." The light emission area C is aligned with the primary light emission axes A, B of each light emitting element 32, 33. In this manner, the light emission area C replicates the light emission window of a traditional tungsten-halogen bulb, without producing unwanted glare.

Referring to FIGS. 6-8 and 12-15, the light source 20 further includes a rotary assembly 22 (e.g., rotating mechanism, ratcheting mechanism, etc.) that rotatably couples the substrate base 24 to a standard bulb base for a vehicle, shown as primary base 21. The rotary assembly 22 can, advantageously, allow for optical alignment or adjustment of the substrates 25 relative to the primary base 21, so as to facilitate creating an optimum beam pattern for the light source 20. For example, with most conventional vehicle light sources, the beam pattern is fixed such that when the light source is installed on a vehicle, any "dim" areas that may be present in the beam pattern cannot be adjusted or mitigated, which may be undesirable in certain applications (e.g., different headlamp designs, reflectors, etc.). In contrast, the rotary assembly 22 can be selectively rotated by an installer between a plurality of angular positions relative to the primary base 21, so as to facilitate adjustment of the beam pattern of the light source 20.

Figure 14:
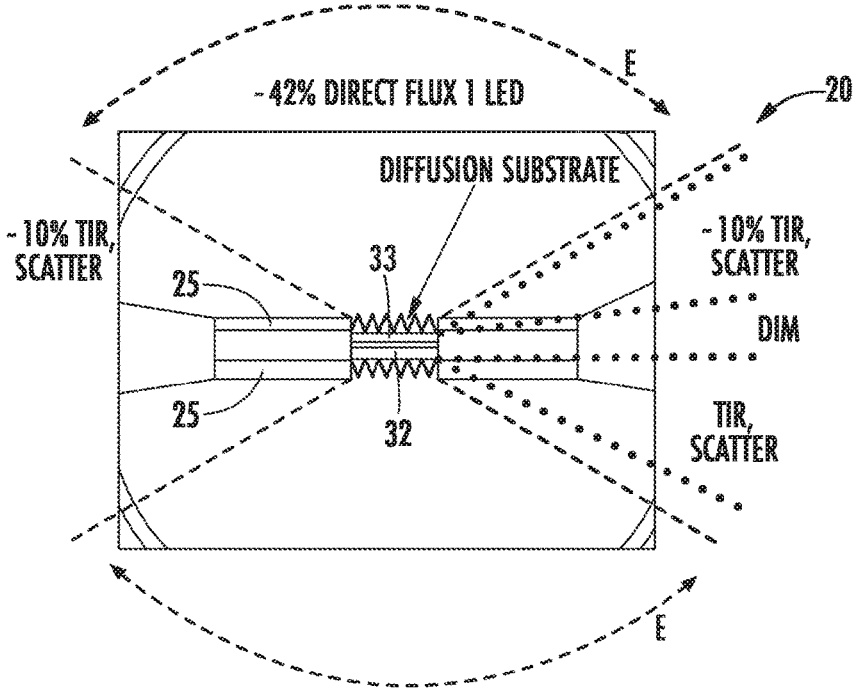
FIG. 14 is a partial front view of the vehicle light source of FIG. 6 illustrating an LED beam pattern of the light source, according to an exemplary embodiment.
Figure 15:
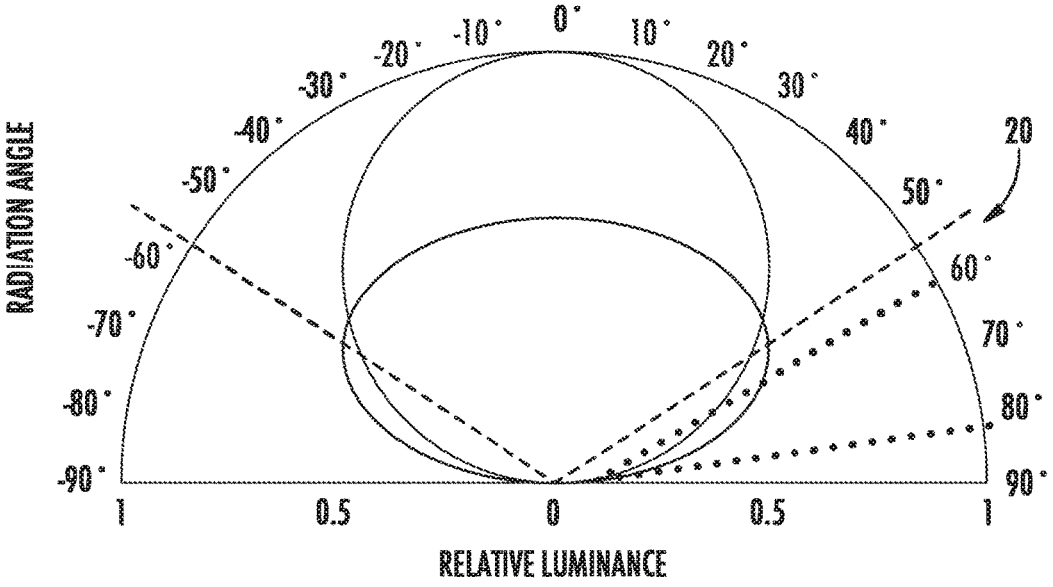
FIG. 15 is a diagram of a beam pattern of the vehicle light source of FIG. 6, according to an exemplary embodiment.
Figure 16:
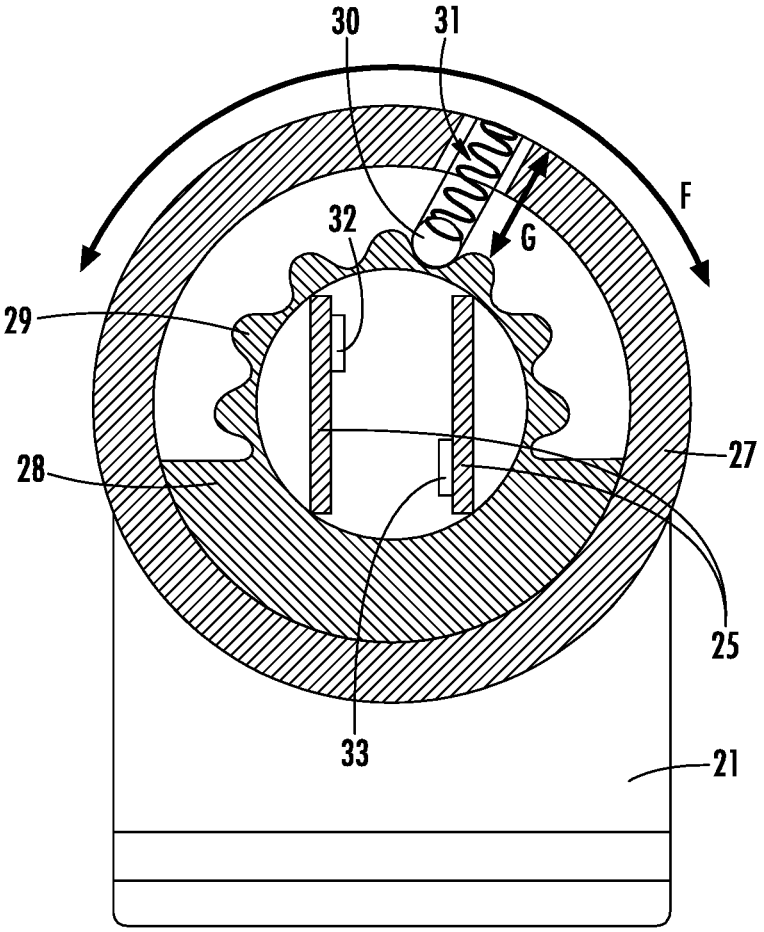
FIG. 16 is a cross-sectional view of the vehicle light source of FIG. 6 taken along line 14-14 in FIG. 8.

For example, referring to FIGS. 14-15, an example beam pattern of the light source 20 is shown according to an exemplary embodiment. As shown in this embodiment, the beam pattern has some light scatter and some total internal reflection (TIR) outside of the 120 degree emission pattern of the light emitting elements 32, 33, which is a result of the transmissivity of the substrates 25 (e.g., less than 100% transmissivity, etc.). The exemplary beam pattern of light source 20 further includes a small "dim" area, which is significantly smaller than the dim area created by conventional aftermarket LED light sources. The rotary assembly 22 can, however, be selectively adjusted in a direction indicated generally by arrows "E" about the optical axis of the light source 20, such that the small dim area of the beam pattern is adjusted or moved to achieve an optimum beam pattern for a particular application. In this way, the beam pattern of the light source 20 is optimized by minimizing the amount of luminous flux lost at highly important test points/areas for desired illumination (e.g., 0.86 degrees down, 3.5 degrees left, 1.5 degrees down, 2.0 degrees left, etc.).

According to an exemplary embodiment, the rotary assembly 22 includes an outer ring member 27 rotatably coupled to an inner ring member 28. The inner ring member 28 is coupled to the substrate base 24 and the substrates 25. The inner ring member 28 can include an opening to allow for wires or other electrical connectors to pass through between the substrates 25 and the primary base 21. The inner ring member 28 includes an undulating portion 29 that defines a plurality of detents disposed along an annular periphery of the inner ring 28. According to an exemplary embodiment, the plurality of detents are spaced apart from each other by between approximately 18 degrees and approximately 20 degrees, although other angular spacing is contemplated, according to other exemplary embodiments. According to the exemplary embodiment shown, the undulating portion 29 extends 180 degrees (i.e., semi-annular). According to other exemplary embodiments, the undulating portion 29 can extend greater than, or less than, 180 degrees about the substrate base 24 and the substrates 25. A ball member 30 and spring 31 are disposed between the outer ring member 27 and the inner ring member 28. The ball member 30 is biased by the spring 31 against the undulating portion 29 of the inner ring member. The inner ring member 28 can be selectively rotated by an installer relative to the outer ring member 27 (or vice versa) in a direction indicated generally by arrow "F," such that the ball member 30 can selectively engage with, and disengage from, the plurality of detents, as indicated generally by arrow "G," to set a rotational position of the substrate base 24 and the substrates 25 relative to the primary base 21. In this way, the beam pattern of the light source 20 can be selectively changed to fit a particular application.

Still referring to FIGS. 6-8 and 12-15, the light source 20 further includes a coupler 23 (e.g., keying mechanism, locking mechanism, etc.) coupled to a periphery of the substrate base 24. The coupler 23 can function to align the substrate base 24 and the substrates 25 relative to a standard bulb base, such as primary base 21. The coupler 23 can include one or more features, such as projections, notches, openings, or other features, that can align with and/or couple to complementary features on the primary base 21 or another component intermediate of the primary base 21 (e.g., rotary assembly 22, etc.). According to the exemplary embodiment shown in the Figures, the primary base 21 is a standard H11 bulb base. It is appreciated, however, that the primary base 21 can be configured as another type of standard bulb base, such as an HB2, HB3, H7, H4, or other type of standard bulb base suitable for a vehicle, according to other exemplary embodiments.

Figure 17:
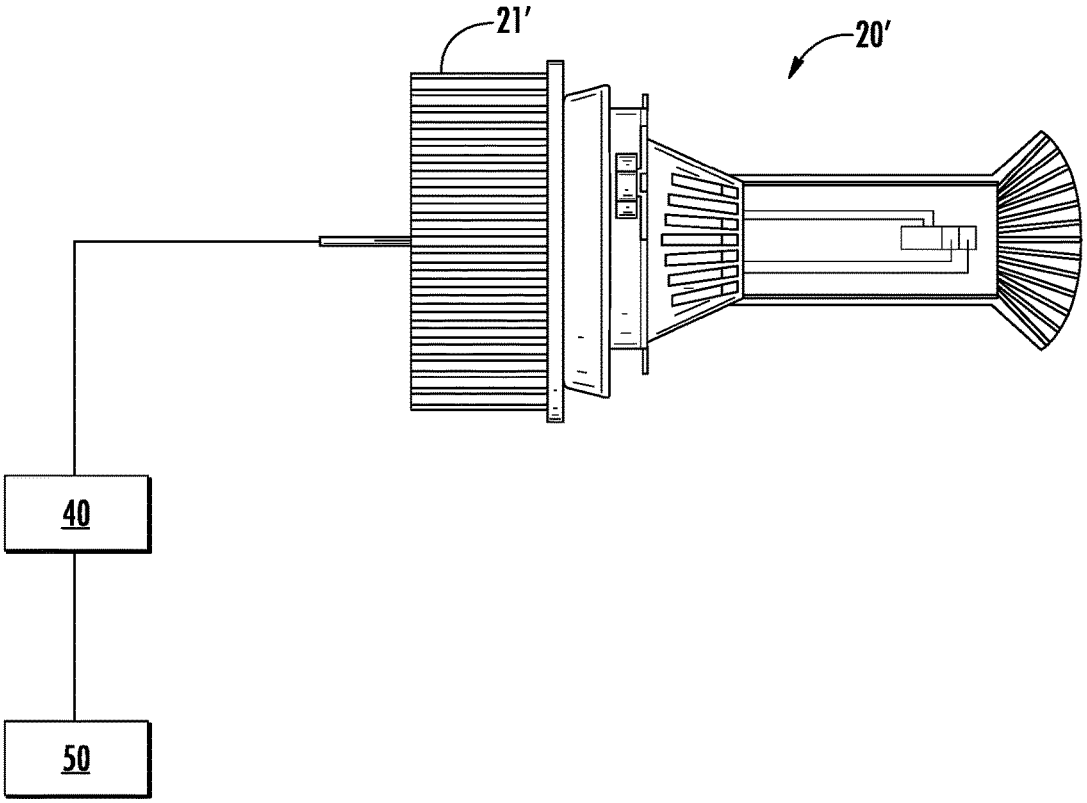
FIG. 17 is a schematic view of a vehicle system including the vehicle light source of FIG. 6 according to an exemplary embodiment.

Referring to FIG. 17, a light source 20' includes a primary base 21' that has an axial socket, according to another exemplary embodiment, instead of a right angle socket, as shown in the embodiment of FIGS. 6-8. The light source 20' is substantially the same as the light source 20 discussed above, except for the configuration of the primary base, the substrate base, and the cap. According to the exemplary embodiment shown, the light source 20' includes one or more fins to function as a heat sink for the light source, such as on the substrate base 24, the cap 26, and the primary base 21'. The light source 20' is shown schematically in FIG. 17 electrically coupled to a power supply 40, which is in turn electrically coupled to a vehicle electrical system 50. According to another exemplary embodiment, the power supply 40 is incorporated into the primary base 21'. According to an exemplary embodiment, the power supply 40 is a single-channel, dual-mode power supply, such as the power supply shown and described in U.S. patent application Ser. No. 14/847,952 (now U.S. Pat. No. 9,764,682) entitled "SYSTEMS AND METHODS FOR VEHICLE LIGHTING," the entire disclosure of which is hereby incorporated by reference herein. According to other exemplary embodiments, the power supply 40 is another type of vehicle power supply capable of controlling the light source 20'.

The disclosed vehicle light source can substantially replicate the beam pattern of a traditional tungsten-halogen bulb, while providing for improved brightness, useful life, reliability, and customization, as compared to traditional tungsten halogen bulbs and aftermarket LED light sources. The disclosed light source includes two substantially parallel substrates and at least one LED coupled to each of the substrates, indirectly across from each other. The substrates include substantially transparent portions that allow for light emitted from the LEDs to pass through an opposite substrate along the primary emission axis of each LED. In this manner, the disclosed light source can provide an improved beam pattern by avoiding displacement of the light center of the LEDs, as compared to typical aftermarket LED light sources. Furthermore, by placing the LEDs on opposite substrates, the thermal resistance of each LED can be reduced and the luminous efficacy improved, because the waste heat produced by the LEDs at the base of each LED die is distributed to separate substrates that are spaced apart from each other, instead of a single substrate. Additionally, the disclosed LED light source includes a rotary assembly that allows for optical adjustment of the resulting beam pattern from the LEDs, to thereby achieve an optimum beam pattern for a particular lighting application, unlike conventional aftermarket LED light sources, which typically have fixed beam patterns.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the vehicle light source as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A light source for a vehicle, the light source comprising:
a first substrate;
a second substrate spaced apart from the first substrate;
a first light emitting element coupled to a surface of the first substrate that faces the second substrate, wherein the first light emitting element is configured to emit light through the second substrate; and
a second light emitting element coupled to a surface of the second substrate that faces the first substrate, wherein the second light emitting element is configured to emit light through the first substrate.

2. The light source of claim 1, wherein the second substrate is oriented substantially parallel to the first substrate.

3. The light source of claim 1, wherein the first substrate includes a substantially transparent portion to allow for light emitted by the second light emitting element to pass therethrough, and wherein the second substrate includes a substantially transparent portion to allow for light emitted by the first light emitting element to pass therethrough.

4. The light source of claim 1, wherein the first substrate and the second substrate are each generally planar.

5. The light source of claim 1, wherein the first substrate is spaced apart from the second substrate a distance of between approximately 0.5 mm and 1.5 mm.

6. The light source of claim 1, wherein at least one of the first light emitting element or the second light emitting element is an LED.

7. The light source of claim 1, wherein the first light emitting element has a primary light emission axis, and wherein the second light emitting element has a primary light emission axis that is offset from, and is substantially parallel to, the primary light emission axis of the first light emitting element.

8. The light source of claim 1, further comprising a substrate base located at a proximal end of the first and second substrates, wherein the first and second substrates extend outwardly away from the substrate base.

9. The light source of claim 8, further comprising a standard bulb base rotatably coupled to the substrate base by a rotary assembly, wherein the rotary assembly is configured to allow for optical adjustment of the first and second substrates relative to the standard bulb base.

10. The light source of claim 8, further comprising a cap located at a distal end of each of the first and second substrates opposite the substrate base, wherein the cap is substantially opaque.

11. A light source for a vehicle, the light source comprising:
a first substrate;
a second substrate spaced apart from the first substrate;
a first LED coupled to a surface of the first substrate that faces the second substrate, wherein the first LED is configured to emit light through the second substrate; and
a second LED coupled to a surface of the second substrate that faces the first substrate, wherein the second LED is configured to emit light through the first substrate.

12. The light source of claim 11, wherein the second substrate is oriented substantially parallel to the first substrate.

13. The light source of claim 11, wherein the first substrate includes a substantially transparent portion to allow for light emitted by the second LED to pass therethrough, and wherein the second substrate includes a substantially transparent portion to allow for light emitted by the first LED to pass therethrough.

14. The light source of claim 11, wherein the first substrate and the second substrate are each generally planar.

15. The light source of claim 11, wherein the first substrate is spaced apart from the second substrate by a distance of between approximately 0.5 mm and 1.5 mm.

16. The light source of claim 11, wherein the first LED has a primary light emission axis, and wherein the second LED has a primary light emission axis that is offset from, and is substantially parallel to, the primary light emission axis of the first LED.

17. The light source of claim 11, further comprising a substrate base located at a proximal end of the first and second substrates, wherein the first and second substrates extend outwardly away from the substrate base.

18. A light source for a vehicle, the light source comprising:
a first substrate including a substantially transparent portion;
a second substrate spaced apart from the first substrate, the second substrate including a substantially transparent portion;
a first light emitting element coupled to a surface of the first substrate that faces the second substrate, wherein the first light emitting element is configured to emit light through the substantially transparent portion of the second substrate; and
a second light emitting element coupled to a surface of the second substrate that faces the first substrate, wherein the second light emitting element is configured to emit light through the substantially transparent portion of the first substrate.

19. The light source of claim 18, wherein the second substrate is oriented substantially parallel to the first substrate.

20. The light source of claim 18, wherein the first light emitting element has a primary light emission axis, and wherein the second light emitting element has a primary light emission axis that is offset from, and is substantially parallel to, the primary light emission axis of the first light emitting element.

* * * * *